US005218264A

United States Patent [19]

Hirai et al.

[11] Patent Number: 5,218,264

[45] Date of Patent: Jun. 8, 1993

[54] IMAGE PICK-UP TUBE AND APPARATUS HAVING THE SAME

[75] Inventors: Tadaaki Hirai, Koganei; Hirofumi Ogawa; Kenji Sameshima, both of Hachioji; Yukio Takasaki; Takaaki Unnai, both of Mobara; Junichi Yamazaki; Misao Kubota, both of Kawasaki; Kenkichi Tanioka, Tokyo; Eikyu Hiruma, Komae, all of Japan

[73] Assignees: Hitachi, Ltd.; Nippon Hoso Kyokai, both of Tokyo, Japan

[21] Appl. No.: 472,886

[22] Filed: Jan. 31, 1990

[30] Foreign Application Priority Data

Feb. 3, 1989 [JP] Japan ..... 1-023670

[51] Int. Cl.[5] ..... H01J 31/26

[52] U.S. Cl. ..... 313/384; 313/370; 313/376; 313/385; 313/544; 313/530

[58] Field of Search ..... 313/370, 376, 366, 378, 313/384, 385, 386, 388, 390, 528, 530, 542, 544, 541

[56] References Cited

U.S. PATENT DOCUMENTS

| | | | |
|---|---|---|---|
| 2,900,569 | 8/1959 | Cope | 313/390 |
| 3,287,581 | 11/1966 | Rome et al. | 313/388 X |
| 3,872,344 | 3/1975 | Shimizu et al. | 313/386 |
| 4,039,888 | 8/1977 | Ashikawa et al. | 313/376 X |
| 4,888,521 | 12/1989 | Tanioka et al. | 313/366 |

FOREIGN PATENT DOCUMENTS

| | | | |
|---|---|---|---|
| 1464377 | 10/1969 | Fed. Rep. of Germany . | |
| 0040809 | 10/1977 | Japan . | |
| 0126237 | 3/1981 | Japan . | |
| 0131349 | 6/1986 | Japan | 313/384 |
| 0206137 | 9/1986 | Japan . | |
| 0072037 | 1/1988 | Japan | 313/384 |
| WO84/00250 | 1/1984 | PCT Int'l Appl. . | |

OTHER PUBLICATIONS

IEEE Electron Device Letters, vol. EDL-8, No. 9 Sep. 1987 pp. 392-394.

Satsuzo Kogaku (Image Pickup Engineering), pp. 109-116, Corona-Sha Dec. 1975.

Preliminary Transactions for National Congress of the Institute of TV Engineers of Japan, pp. 81-82, Dec. 1982.

*Primary Examiner*—Donald J. Yusko
*Assistant Examiner*—Ashok Patel
*Attorney, Agent, or Firm*—Antonelli, Terry, Stout & Kraus

[57] ABSTRACT

An image pick-up apparatus is disclosed which includes a target portion having a photoconductive film on a substrate and a target electrode and reads video information converted into an electric signal in the photoconductive film by an electron beam. An insulating region is provided for the target portion such that carrier generated in an ineffective scanned region (a target region corresponding to an area not scanned by the electron beam) does not appear on a surface of the target portion.

30 Claims, 8 Drawing Sheets

IMAGE PICK-UP TUBE AND APPARATUS HAVING THE SAME

BACKGROUND OF THE INVENTION

1. Field of the Invention

The present invention relates to an image pick-up tube and, specifically, to a structure of a target portion of an image pick-up tube of a photoconductive type for visible light or for x-rays. More particularly, the present invention relates to improvement of the target portion suitable for the image pick-up tube used with a increased target voltage.

2. Description of the Related Art

Generally, a photoconductive type image pick-up tube or an x-ray image pick-up tube (to be called an image pick-up tube as a general term hereinafter) includes a target portion for converting an incident light or x-ray image into a charge pattern to accumulate a charge, and an electron beam scanning section for reading the charge pattern to obtain a current signal. Immediately after the target portion is scanned by an electron beam, the image pick-up tube operates to balance a surface potential on the scanned side of the target portion with a cathode potential. Such an image pick-up tube is described in, for example, "Satuzou Kougaku (imaging engineering)", pp. 109–116, by Ninomiya et al., published by Corona-sha, 1975, IEEE Electron Device Letters, 1987, EDL-8, No. 9, pp 392–394, or Preliminary Transactions for National Congress of the Institute of Television Engineers of Japan, 1982, pp. 81–82, by Kawamura, et al.

With such an image pick-up tube, if secondary electrons are easily emitted from a surface of a target portion on a side scanned by an electron beam, the normal operation mentioned above of the image pick-up tube cannot be achieved. In order to decrease a secondary electron emission yield on the scanned side surface, a method is disclosed, in which an electron beam landing layer composed of porous $Sb_2S_3$ is deposited on the scanned side surface of the target portion in inert gas by evaporation (JP-B-52-40809). In addition, in order to suppress a false signal generated when excess electrons are reflected by an electrode in the tube during scanning an electron beam and come into the target portion again so as to obtain an output signal of a high S/N ratio, some methods are disclosed; in one method, a new electrode is provided on an area of the scanned side surface of the target portion except for an area scanned by an electron beam (JP-A-61-131349) and in another method, a transparent conductive film of the target on the light or x-ray incident side is separated into two portions in correspondence with a portion scanned by an electron beam and the other portion and the two portions are connected to individual power supplies to control an operation of the tube (JP-A-63-72037).

With the image pick-up tube according to the above conventional methods, it is necessary to make a photoconductive layer of target portion thick in order to increase its sensitivity and decrease capacitive afterimage. In addition, it is necessary to make a voltage between a target electrode and a cathode electrode of the image pick-up tube (to be referred as a target voltage hereinafter) higher in order to cause avalanche multiplication in the photoconductive layer so as to realize higher sensitivity. However, if such an image pick-up tube is used with the higher target voltage, a bad phenomena such as a phenomenon that image distortion or shading appears in a reproduced image on a monitor; a phenomenon that an abnormal pattern varying in a ripple manner is generated in the periphery of the reproduced image (to be referred to as a water fall phenomenon), and a phenomenon that the polarity of a portion of an output signal from the tube corresponding to the periphery of the reproduced image is inverted (to be referred to as a signal inversion phenomenon). Therefore, there is, in the conventional image pick-up tube, a problem in which it is difficult to stably obtain a better reproduced image.

SUMMARY OF THE INVENTION

The present invention solves the problem of the conventional image pick-up tube, and its object is to provide an image pick-up tube including a target capable of suppressing generation of the above bad phenomena even at a higher target voltage and stably obtaining the better reproduced image; an image pick-up apparatus employs the image pick-up tube.

In accordance with one aspect of the present invention, there is provided an image pick-up tube having a target portion which includes a substrate for permeating electromagnetic wave, such as light or x-ray, having video information of a subject, a target electrode, a photoconductive region having a function (a photoelectric conversion function) for generating carriers by absorption of the electromagnetic wave, and means disposed in at least one portion of an ineffective scanned region, which is a region of the target portion except for an effective scanned region, which is a region corresponding to an area scanned by an electron beam, for blocking arise or fluctuation of a potential on the surface of the target portion on a side scanned by the electron beam, and an image pick-up apparatus employing the image pick-up tube.

One of effective means for blocking the rise or the fluctuation of the potential is realized by an insulating thin film with a high resistance. "The at least one portion of the region except for the effective scanned region" is in that area of the target portion which is not scanned by the electron beam and may be in an arbitrary location between the target electrode and the scanned side surface in a direction perpendicular to the layers in the target portion. When the means is realized by the insulating thin film, the film is provided as a single layer or as a plurality of layers. Typically, the higher the resistance of film is, the more remarkable the effect becomes. However, the effect is greater when the resistance is higher than the dark resistance of the photoconductive region or film and the effect is less when it is lower than the dark resistance. Therefore, the resistivity of the insulating thin film is preferably substantially higher than $10^{12}$ Ω-cm The insulating thin film is mainly composed of material with high resistance such as oxide, halogenide, nitride, carbide, compound of II-VI groups, or organic material. More specifically: an oxide or oxides of at least one of Mg, Al, Si, Ti, Mn, Zn, Ge, Y, Nb, Sb, Ta and Bi; a fluoride or fluorides of at least one of Li, Na, Mg, Al, K, Ca, Ge, Sr, In and Ba; a nitride or nitrides of at least one of B, Al and Si; silicon carbide; zinc sulfide; or a polyimide insulator is effective as the material. The insulating thin film including a single layer which is mainly composed of at least one material selected from among the above materials, or a multiple film obtained by laminating the single layers of two or more types is available.

Preferably, in order to decrease secondary electron emission from the surface area of the ineffective scanned region, the insulating thin film or the photoconductive film is made porous or a single or multiple porous film is provided on the photoconductive film. A compound of at least one selected from the group consisting of Zn, Cd, Ga, In, Si, Ge, Sn, As, Sb and Bi and at least one selected from the group consisting of S, Se and Te is used as the material of the porous film. The secondary electron emission yield is controlled on the basis of the thickness of the porous film, composed of the above compound, which is formed in inert gas by evaporation, and the pressure of the inert gas upon the evaporation.

In accordance with another aspect of the present invention, there is provided with an image pick-up tube including a substrate for permeating electromagnetic wave, a first electrode, a photoconductive structure for generating carriers by absorbing the electromagnetic wave, a second electrode for radiating an electron beam for obtaining an electric signal in accordance with distribution of the carriers generated in the photoconductive structure, and means for substantially balancing a potential on an area of the surface of the photoconductive structure except for an area of an effective scanned region on a side scanned by the electron beam, with a potential of the second electrode, and an image pick-up apparatus employing the tube. Such an image pick-up tube operates in a state having means for scanning the electron beam and an outer tube for sealing.

The means for balancing the surface potential with the potential of the second electrode prevents the surface potential of the area corresponding to the ineffective scanned region from balancing with a potential of the first electrode. Therefore, the present invention in which such means is provided in or on the photoconductive structure, is specifically effective for the image pick-up tube having the photoconductive structure to which strong electric field is applied to cause it operate.

In accordance with still another aspect of the present invention, there is provided an image pick-up tube including a substrate, a structure having a photoconductive region for receiving incident video information of light of x-ray and generating carriers by photoelectric conversion or x-ray to electric conversion, the structure having a surface scanned by an electron beam, and an electrode provided between the substrate and the structure, and wherein a region of the structure corresponding to an area not scanned by the electron beam (an ineffective scanned region) includes means for preventing the carrier from running in the ineffective scanned region.

The preventing means prevents the carrier generated in the ineffective scanned region of the photoconductive region from running toward the scanned surface of the structure (due to electric field externally applied). The above bad phenomena are caused by the carrier in the inefffective scanned region. If such carrier appear on the scanned surface and change the surface potential of the structure, it is difficult to stably take out a better video signal. That is, the inventors studied the above image distortion, shading, water fall phenomenon and signal inversion phenomenon in detail and understood that the bad phenomena are due to the following factors.

Generally, the image pick-up tube of a photoconductive type is used under application of 200 to 2,000 V to the mesh electrode and a few to a few hundreds V to the target electrode with respect to the cathode electrode. Electrons in the electron beam sequentially adhere on the surface of the effective scanned area of the target portion for every field period during an operation of the tube. Therefore, the surface potential of the effective scanned area substantially balances with the potential of the cathode immediately after the beam is scanned and excess electrons when the beam is scanned return to the cathode. These excess electrons are called a returning electron beam. Photocurrent occurs in the photoconductive layer when light is radiated and the surface potential is raised by a voltage determined on the basis of an amount of radiated light for the field period and capacitance of the photoconductive film. This raised voltage is at most a few to a few tens V in a normal operation and the surface potential restores to substantially the cathode potential until a next electron beam scan.

On the other hand, the area corresponding to the ineffective scanned region is not directly scanned by the electron beam. Therefore, the surface potential of the area does not always become the cathode potential. It tends to balance with the potential of the target electrode rather than that of the cathode. It is because when difference between the potentials on the surfaces of the photoconductive film occurs in the ineffective scanned region, the dark current and the photocurrent generated due to incoming of stray light or scattered light into the tube flows in a direction eliminating the difference between the potentials. Therefore, the more the target voltage is increased, the higher the surface potential of the ineffective scanned area becomes, with the result that a great potential difference occurs between the effective and ineffective scanned regions. For this reason, the electron beam scanning nearby the boundary of the surface areas corresponding to the effective and ineffective scanned regions is deflected due to influence of the surface potential of the ineffective scanned region, so that it becomes difficult for the electron beam to vertically come into the target. As a result, the image distortion or shading phenomenon is generated in a reproduced image corresponding to neighborhood of the boundary of the effective and ineffective scanned region.

In addition, when the surface potential in the ineffective scanned region is high, the surface potential acts on stray electrons such as the secondary electrons generated in the tube, electrons in the returning electron beam, and the scattered electrons resulting from reflected electrons by the electrodes, such that the ineffective scanned region absorbs the stray electrons to actively emit the secondary electrons as the surface potential becomes high. As a result, the surface potential in the ineffective scanned region varies complexly and becomes unstable, with the result that the water fall phenomenon is generated. When the secondary electron emission yield exceeds one, the surface potential of the ineffective scanned region acceleratingly is increased to exceed the potential of the target electrode, and finally the region of the high surface potential invades the effective scanned region, thereby resulting in the signal inversion phenomenon.

As described above, the bad phenomena for a reproduced image appeared at the periphery of the reproduced image on a monitor such as image distortion, shading, water fall phenomenon and signal inversion phenomenon are caused by the rise of the surface potential on the ineffective scanned region during the operation of the tube. However, in the present invention, an insulating thin film of high resistance is provided in at least one portion of the ineffective scanned region of the image pick-up tube target portion. Therefore, the operation that the surface potential of the at least one portion which rises to balance with the target potential can be suppressed.

In addition, since there remains only the phenomenon that the surface potential of the at least one portion is lowered due to adhesion of stray electrons in the tube, the surface potential in the ineffective scanned region tends to balance with the cathode potential, thereby to suppress generation of the bad phenomena such as the image distortion, the shading, the water fall phenomenon and the signal inversion phenomenon.

Further, when a porous thin film is provided for suppressing the secondary electron emission yield on the surface of the ineffective scanned region, the effect of the present invention can be achieved more effectively and stably.

Furthermore, the present invention is disclosed, as an example of the image pick-up tube of the photoconductive type. However, the present invention can be apparently applied to an image pick-up tube for x-rays using a Be or Ti thin plate with a high permeability for the x-rays as the substrate. Generally, in order to increase an amount of absorption of incident x-rays in the x-ray image pick-up tube, the thickness of an x-ray film (it is called a photoconductive film as a general term without differing it from another photoconductive film hereinafter) is increased to operate the tube at a higher target voltage. As a result, the bad phenomena described above are easily caused. However, these are remarkably suppressed according to the present invention.

Still more, the present invention is applied to an image pick-up tube of a carrier multiplication type which is used with so high of a target voltage that avalanche multiplication of charges occurs in the photoconductive film, the high sensitivity that the quantum efficiency exceeds one can be obtained while the bad phenomena such as image distortion, shading, water fall phenomenon, and signal inversion phenomenon are suppressed.

The present invention requires no limitation of the photoconductive film of the image pick-up tube and can be applied to image pick-up tubes of various types. More particularly, when the present invention is applied to an image pick-up tube of a blocking type, at least one portion of whose photoconductive film is composed of Se or Si as a main component; the remarkable effect can be obtained, and in this case, a reproduced image with high sensitivity, high resolution, and low after-image can be obtained.

Still further advantages of the present invention will become apparent to those of ordinary skill in the art upon reading and understanding the following detailed description of the preferred embodiment.

BRIEF DESCRIPTION OF THE DRAWINGS

The invention may take in various parts and arrangement of parts. The drawings are only for purposes of illustrating the preferred embodiments and are not to be construed as limiting the invention.

DESCRIPTION OF THE PREFERRED EMBODIMENTS

Figure 1A:
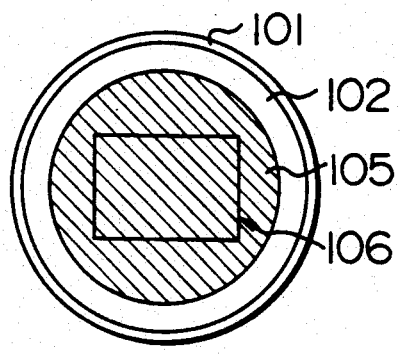
FIGS. 1A and 1B illustrate a structure of an image pick-up tube according to an embodiment of the present invention.
Figure 1B:
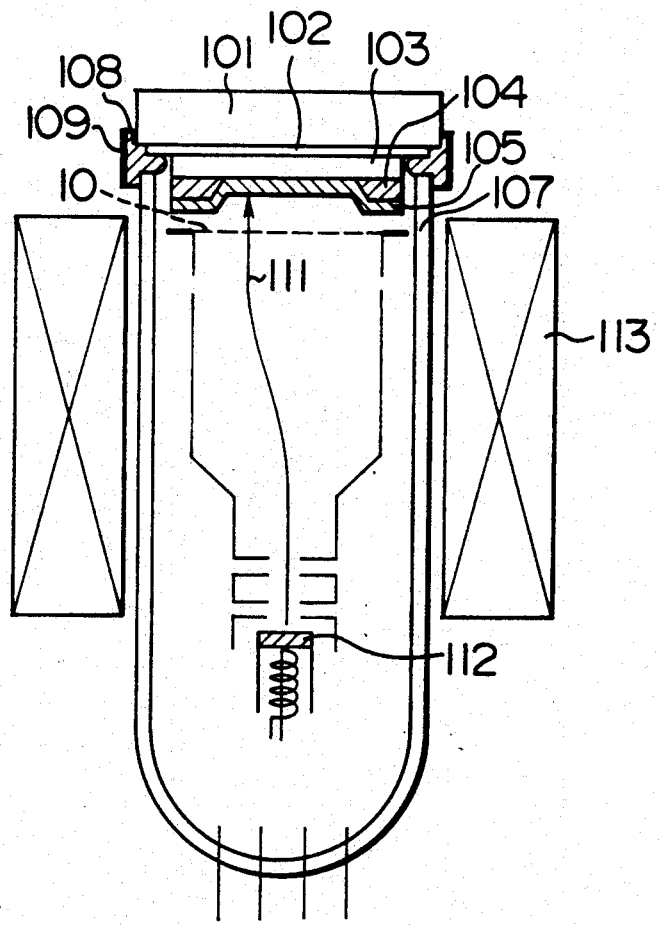
Figure 2A:
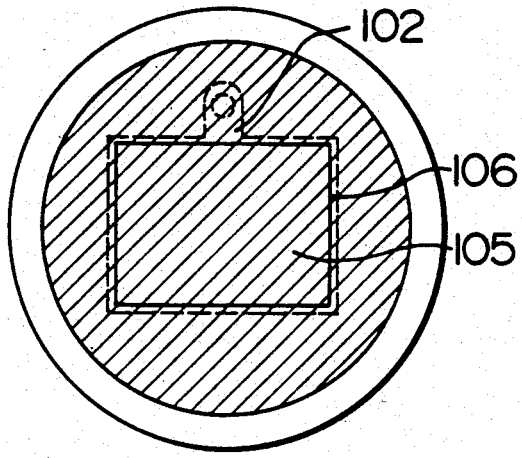
FIGS. 2A, 3A, 4A and 5A are plan views illustrating surfaces of target portions of image pick-up tubes according to additional embodiments of the present invention when the target portions are viewed from an electron-beam-scanned side, respectively.
Figure 2B:
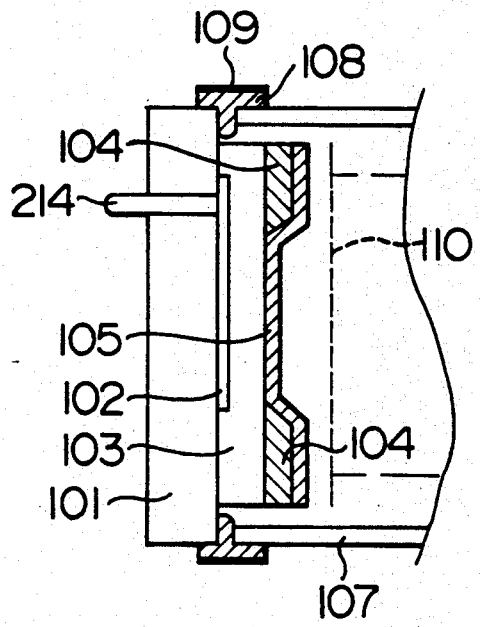
FIGS. 2B, 3B, 4B and 5B illustrate structural cross sections of the target portions in FIGS. 2A, 3A, 4A and 5A, respectively.
Figure 3A:
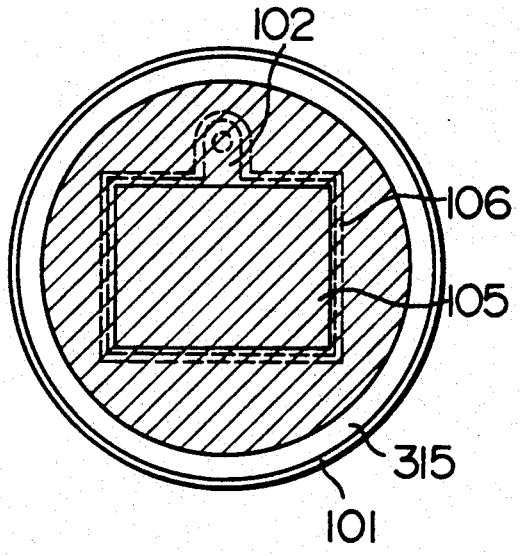
Figure 3B:
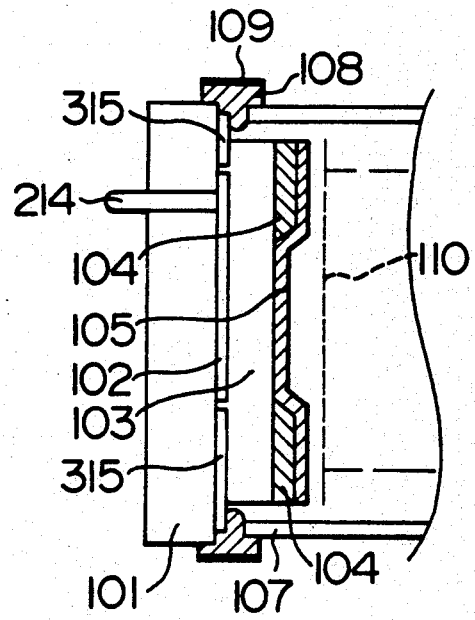
Figure 4A:
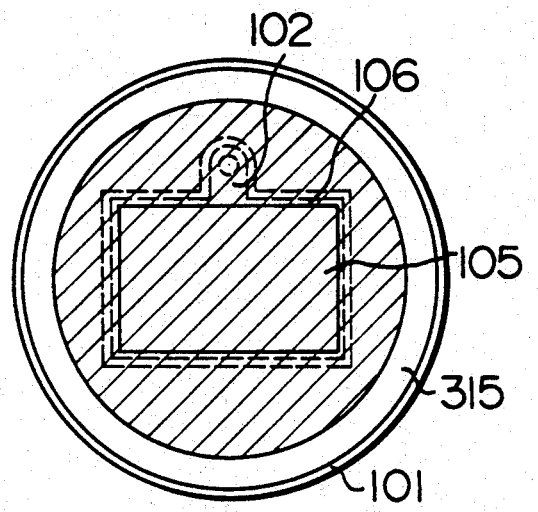
Figure 4B:
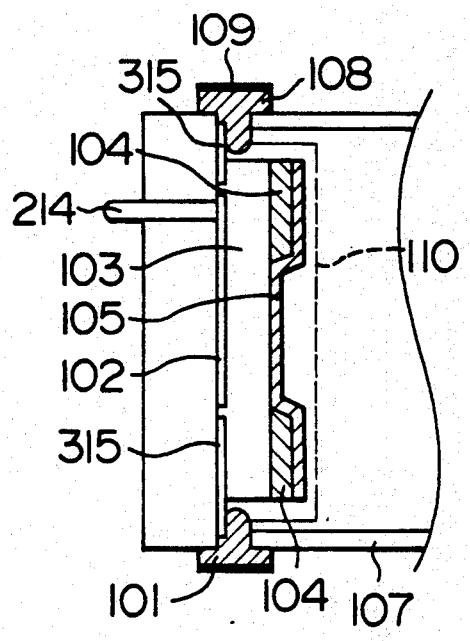
Figure 5A:
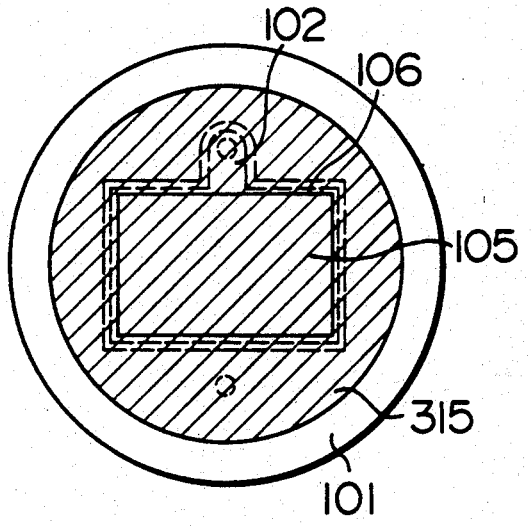
Figure 5B:
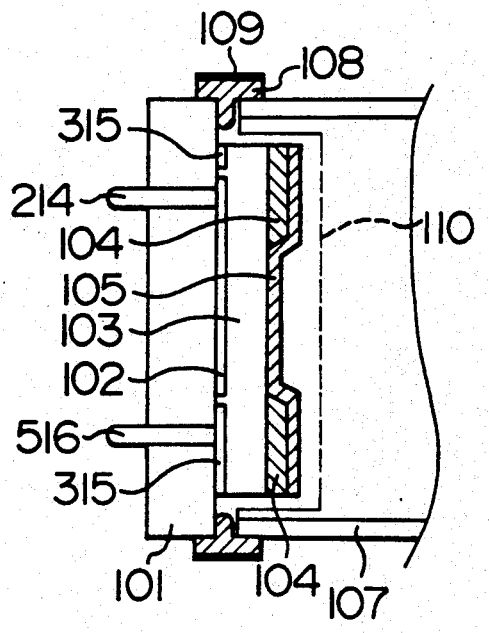

With reference to FIGS. 1A and 1B, one embodiment according to the present invention will be described. FIG. 1A is a plan view showing a target portion of an image pick-up tube when the target portion is viewed from the side scanned by an electron beam, and FIG. 1B shows a cross section showing a major portion of the image pick-up tube. The target portion of the image pick-up tube includes a target electrode 102, a photoconductive film 103, an insulating thin film 104 as an insulating means, and a surface layer 105 on the scanned side, which are in turn provided on a substrate 101.

The substrate 101 is composed of material permeating image information, i.e., light or x-ray from a subject and transparent glass is available for the substrate. A conductive film is formed of indium oxide, tin oxide, or the like as a main component by sputtering or electron beam evaporation, to provide the transparent target electrode 102. A thin film of metal such as Be is also available for the conductive film.

The photoconductive film 103, which is mainly composed of semiconductive material, e.g., an amorphous semiconductor having Se or a tetrahedral element as a main component, such as amorphous-Se, amorphous-Si:H, or amorphous-SiC:H, is formed on the target electrode by vacuum evaporation. The photoconductive film may be a single layer structure or a laminating structure having a plurality of layers composed of different semiconductive materials. More specifically, a two-layer or three-layer structure is available for the photoconductive film 103. In a case of the two-layer structure, the photoconductive film 103 includes a first photoconductive film which is formed on a target electrode side thereof and a second photoconductive film which is formed on an electron beam scanned side thereof. The first photoconductive film is mainly composed of material having a remarkably large absorption coefficient at a wavelength of incident light or x-ray, e.g., an amorphous semiconductor containing hydrogen and having Si, or Si and C as main components. The second photoconductive film is mainly composed of material suitable for carriers (holes), which are generated in the first photoconductive film, to run toward the scanned side, e.g., an amorphous semiconductor having Se as a main component. In a case of the above three-layer structure, the film 103 further includes a third photoconductive film, provided between the first and second photoconductive films, for the carriers smoothly running between them.

A positive carrier injection blocking structure, e.g., a Schotty barrier (not shown) is provided between the target electrode 102 and the photoconductive film 103 to block injection of the positive carriers from the electrode 102 into the film 103, thereby to lower a dark current, though the structure is not shown in the figure. In order to enhance the blocking function, a special carrier injection blocking layer made of material such as n-type amorphous-SiC:H or cerium oxide may be provided.

In this embodiment, the insulating film 104 is provided on the photoconductive film 103. The film 104 is formed of aluminum oxide, silicon oxide, $Al_2F_3$, yttrium oxide, $Sb_2S_3$, or the like by sputtering. The film 104 acts such that carriers, which are generated in an ineffective scanned region by the dark current, stray lights, or scattered lights, do not run under an applied electric field and do not appear on a surface area of the ineffective scanned region on the scanned side. When these carriers, i.e., charges which are unnecessary for a video signal move to the scanned surface of the target portion, it is considered that the fluctuation of an electric surface potential of the target portion due to these carriers gives the bad influence to an effective scanned region, thereby resulting in the water fall phenomenon and the signal inversion phenomenon.

The surface layer 105 acts such that an emission yield of secondary electrons to incident electrons does not exceed one, the secondary electron being generated due to impact of the incident electrons accelerated by the target voltage. A numeral 106 in FIG. 1A indicates a boundary of an area of the effective scanned region for the electron beam. The image pick-up tube includes, other than the above components, an outer tube 107, a sealing material composed of indium or the like for coupling the substrate 101 to the outer tube 107 and sealing the inside of the outer tube 107 in a vacuum state, a metallic ring 109, a mesh electrode 110 for accelerating the electron beam 111, a cathode electrode 112 for emitting the electron beam, and a coil 113 for deflecting and focusing the electron beam.

An image pick-up tube having a scanning electron beam generating section of an electromagnetic deflection electromagnetic focusing system is shown in FIG. 1B as an example. However, the deflection focusing system of the electron beam is not limited to the above system, and a system such as an electromagnetic deflection electrostatic focusing system, an electrostatic deflection electromagnetic focusing system or an electrostatic deflection electrostatic focusing system may be employed, as well known.

In the embodiment, the insulating thin film 104 are provided on the photoconductive layer 103 and in an area of the target portion except for an effective scanned region. The surface layer 105 is provided on the insulating thin film 104 and the effective scanned region of the photoconductive film 103.

FIGS. 2A to 5B show structures of the target portions of the image pick-up tubes according to other embodiments of the present invention. FIGS. 2A, 3A, 4A and 5A are plan views showing the surfaces of the target portions in the other embodiments when they are viewed from the scanned side, and FIGS. 2B, 3B, 4B and 5B show structural cross sections of the target portions according to the other embodiments. The components indicated by numerals 101 to 110 are the same as those shown in FIGS. 1A and 1B. Numeral 214 indicates a target electrode pin connected to the target electrode 102. Numeral 315 indicates a guard electrode which is provided in the ineffective scanned region and is separated and insulated from the target electrode. Numeral 516 indicates a guard electrode pin connected to the guard electrode.

In any one of the other embodiments, the insulating thin film 104 is provided between the photoconductive film 103 and the surface layer 105 in the ineffective scanned region of the target portion. Therefore, each of these image pick-up tubes operates similarly to that shown in FIGS. 1A and 1B. In addition, in each of the image pick-up tubes shown in FIGS. 2A to 5B, the transparent conductive layer as the target electrode 102 has a minimum of area necessary for an output signal to be read from the target electrode pin 214 and hence a structure for decreasing stray capacitance as much as possible is employed. Therefore, in addition to the suppression of the above-mentioned bad phenomena for the reproduced image, a signal-to-noise (S/N) ratio can be increased, as compared to the image pick-up tube shown in FIGS. 1A and 1B.

Particularly, in the image pick-up tubes shown in FIGS. 3A, 3B, 5A and 5B, the metallic ring 109 or the guard electrode pin 516 is connected to a new and different power supply to allow the guard electrode 315 to operate at a voltage lower than the target voltage. Therefore, even if a further higher voltage is applied to the target electrode and the mesh electrode to operate them, there is a remarkable advantage in that the above-mentioned bad phenomena for the reproduced image can be suppressed.

Figure 6A:
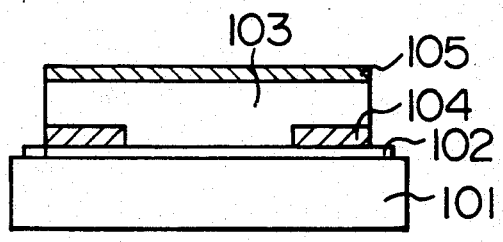
FIGS. 6A, 6B, 6C and 6D illustrate structural cross sections of the target portions according to further additional embodiments of the present invention.
Figure 6B:
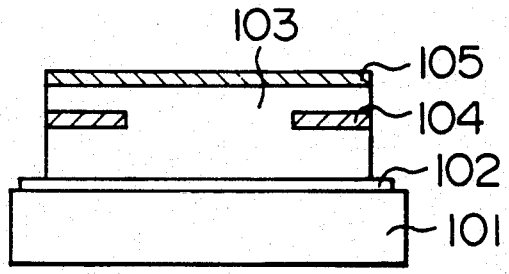
Figure 6C:
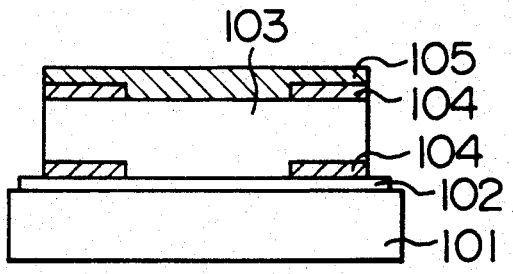
Figure 6D:
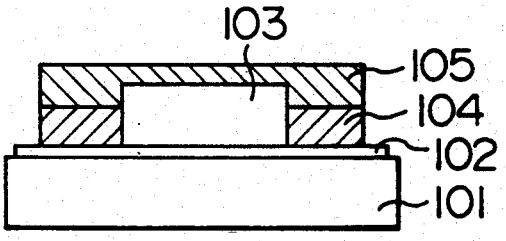

In the embodiments shown in FIGS. 1A to 5B, the image pick-up tubes according to the present invention wherein the insulating thin film is provided between the photoconductive film 103 and the surface layer 105 in the ineffective scanned region of the target portion of the image pick-up tube, are described. However, the insulating thin film 104 is not necessarily provided in the region shown in each figure. As shown in FIGS. 6A to 6C, in the ineffective scanned region of the target portion, the film 104 may be provided between the photoconductive film 103 and the target electrode 102 (FIG. 6A) or inside of the photoconductive film 103 (FIG. 6B). In addition, a plurality of insulating thin films may be provided on the surface of or inside of the photoconductive film 103 (FIG. 6C). Furthermore, the entire ineffective scanned region of the photoconductive film 103 may be replaced by the insulating thin film 104, thereby obtaining the same effect.

Figure 7A:
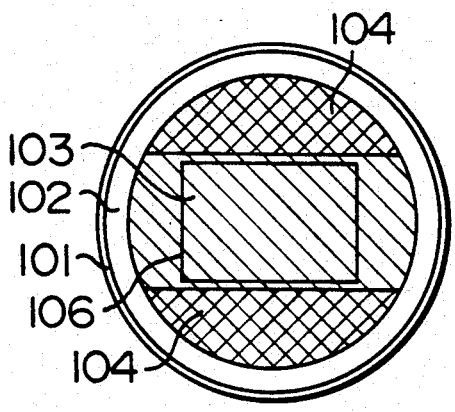
FIGS. 7A, 7B, 7C, 8A, 8B, 9A, 9B are plan views illustrating target portions according to still additional embodiments of the present invention.
Figure 7B:
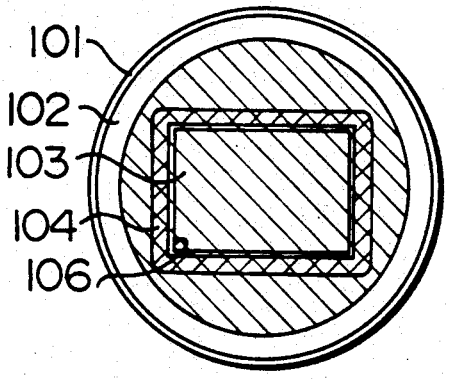
Figure 7C:
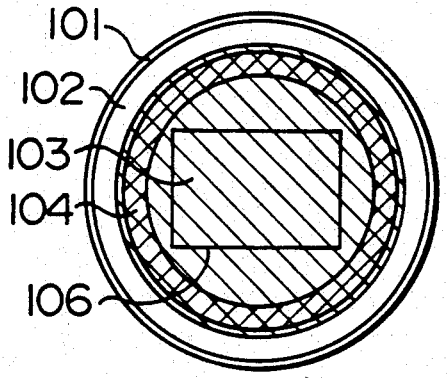

The insulating thin film is not necessarily provided on the entire ineffective scanned region of the target portion of the image pick-up tube. For example, as shown by double oblique lines in plan views of FIGS. 7A, 7B and 7C, the insulating thin film 104 may be provided in a portion of the ineffective scanned region on the target portion. In these cases, the effect is achieved in its own way.

The target portion of the image pick-up tube according to the present invention will be described below, taking examples.

EXAMPLE 1

On a substrate with 26 mmϕ in diameter composed of transparent glass, a transparent conductive film having indium oxide as a main component is formed by sputtering or evaporation by electron beam. On the film, a hole injection blocking layer with 20 nm in thickness is formed of cerium oxide by vacuum evaporation and, on the layer, a photoconductive film with 1 to 10 μm in thickness is formed of an amorphous semiconductor having Se as a main component.

On the photoconductive film, an insulating thin film with 0.5 to 5 μm in thickness is formed of $Al_2F_3$ by vacuum evaporation. At this time, a metallic plate evaporation mask is used so as not to evaporate $Al_2F_3$ on the effective scanned region of the photoconductive film. Then, antimony trisulfide is evaporated on the entire surface in an Ar gas with 0.2 Torr in pressure to form, a porous surface layer with 0.1 μm in thickness, thereby obtaining the image pick-up tube target.

EXAMPLE 2

Figure 8A:
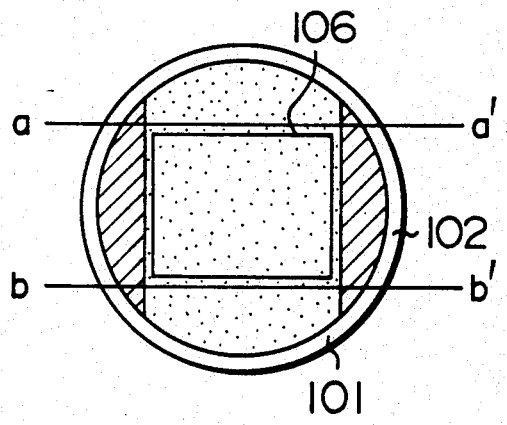

With reference to FIG. 8A, an example 2 will be explained. In the figure, a transparent conductive film having indium oxide as a main component is formed, as a target electrode 102, in an area surrounded by lines a—a' and b—b' on a substrate 101 with 18 mmϕ in diameter composed of transparent glass. In an oblique line portion of the figure, $BiO_2$ is deposited in a composite gas of argon and oxygen, with 0.3 Torr in pressure to form a porous insulating thin film with 1 to 5 μm. Then, in a dot-scattered area shown in the figure, a cerium oxide thin film, an amorphous semiconductive film having Se as a main component, and a porous antimony trisulfide layer are formed by a technique similar to that of the example 1, thereby obtaining the image pick-up tube target.

EXAMPLE 3

Figure 8B:
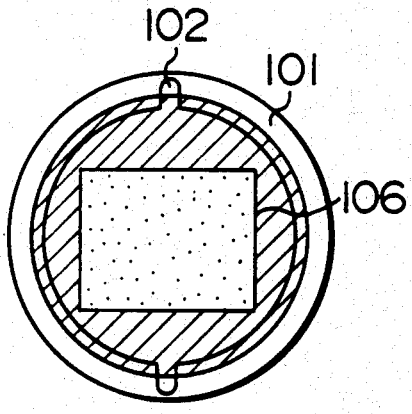

With reference to FIG. 8B, an example 3 will be described. In the figure, a transparent conductive film having tin oxide as a main component is formed, as the target electrode 101, on the surface of a substrate 102 composed of transparent glass by CVD. In an oblique line portion of the figure, an insulating thin film with 0.5 to 5 μm in thickness is formed of silicon oxide by sputtering. Then, in the oblique line portion and dot-scattered portion, the hole injection blocking layer with 10 nm in thickness is formed on n-type amorphous hydride SiC by glow discharge CVD, and, on the blocking layer, the photoconductive film with 0.1 to 1 μm is formed of amorphous hydride Si. Subsequently, on an area of the amorphous Si film corresponding to the oblique line portion, an insulating thin film with 0.5 to 5 μm in thickness is formed of silicon oxide. Then, in the oblique line portion and the dot-scattered portion, an amorphous semiconductive film with 1 to 5 μm having Se as a main component is formed by vacuum evaporation and, on the amorphous semiconductive film, $Sb_2S_3$ is deposited in Ar gas with 0.2 Torr in pressure to form a porous surface layer with 0.1 μm in thickness, thereby providing the image pick-up tube target.

EXAMPLE 4

Figure 9A:
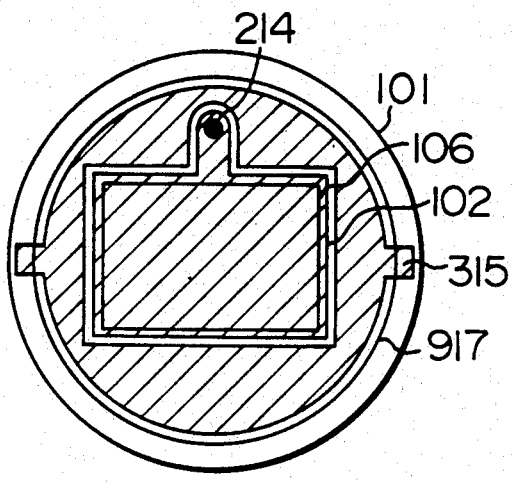

With reference to FIG. 9A, an example 4 will be described below. A hole is formed in the substrate 101 composed of transparent glass and the signal electrode pin 214 is welded thereto. A transparent conductive film composed of indium oxide as a main component is formed on an entire surface of the glass substrate 101. The transparent conductive film is processed in a shape shown by the oblique line portion in FIG. 9A by normal chemical etching to provide the target electrode 102 and the guard electrode 315. In an area inside of a circle 917 representing boundary of the photoconductive film except for the effective scanned region, the insulating thin film with 0.5 to 5 μm in thickness composed of aluminum oxide by sputtering.

On the entire area inside of the circle 917, the hole injection blocking layer with 20 nm in thickness composed of cerium oxide and the photoconductive film with 1 to 10 μm in thickness composed of an amorphous semiconductor having Se as a main component are formed by a method similar to that in the example 1. On the film, CdTe is deposited in nitrogen gas with 0.4 Torr in pressure to form a porous surface layer with 0.1 μm in thickness, thereby providing the image pick-up tube target.

EXAMPLE 5

Figure 9B:
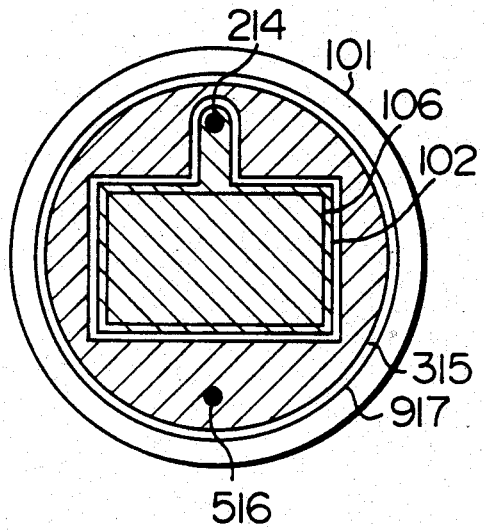

With reference to FIG. 9B, an example 5 will be described below. Holes are formed in the substrate 101 composed of transparent glass and the signal electrode pin 214 and the guard electrode pin 516 are welded to them. The guard electrode 315 composed of Cr-Au is formed thereon by vacuum mask evaporation. A transparent conductive film composed of indium oxide as a main component is deposited on the entire surface. The transparent conductive film is processed in the shape shown in the figure by chemical etching to provide the target electrode 102. The hole injection blocking layer and the photoconductive layer are formed thereon under the same condition as in the example 4 $Sb_2S_3$ is deposited in Ar gas with 0.2 Torr in pressure to form a porous surface layer with 0.1 μm in thickness, thereby providing the image pick-up tube target.

EXAMPLE 6

Figure 10A:
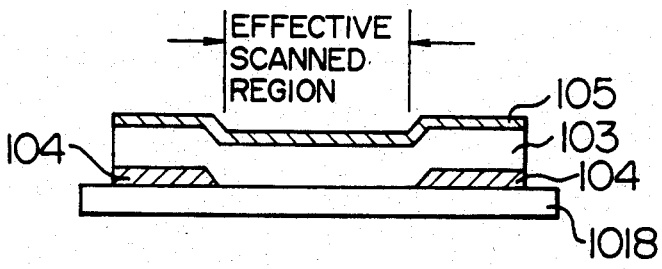
FIGS. 10A and 10B are cross sections of the target portions of the image pick-up tubes according to still another additional embodiments of the present invention.
Figure 10B:
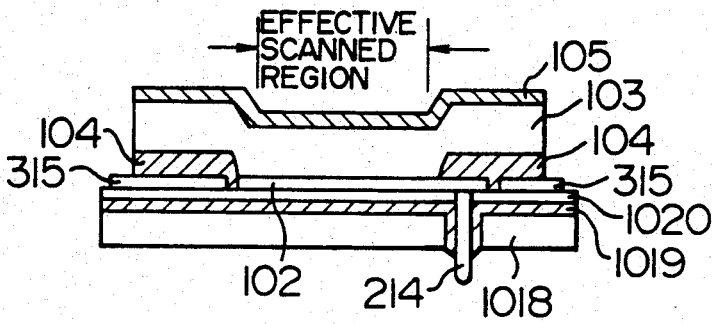

FIGS. 10A and 10B are rough cross-sections showing the target portion of the image pick-up tube according to an embodiment of the present invention. In the embodiment, a conductive Be thin plate is used as the substrate and also serves as the target electrode. As shown in FIG. 10A, an insulating multiple thin films, which have thickness of 0.5 to 5 μm and are mainly composed of yttrium oxide and silicon oxide, respectively, are formed in the area of the Be thin plate substrate 101 outside of the effective scanned region. A hole injection blocking layer (not shown) with 20 nm in thickness composed of cerium oxide and an amorphous semiconductive film with 4 to 50 μm composed of Se as a main component are formed on the entire surface except for an indium seal portion in the outer portion. Further, $Sb_2S_3$ is deposited in Ar gas with 0.3 Torr in pressure to form a porous surface layer with 0.1 μm in thickness, thereby providing the image pick-up tube target for x-ray.

EXAMPLE 7

With reference to FIG. 10B, an example 7 will be described below. As shown in FIG. 10B, a conductive Be thin plate 1018 having a hole for allowing the target electrode pin 214 to pass therethrough, an insulating glass thin plate 1020, and the target electrode pin 214 are adhered to each other by an insulative adhesive to provide the substrate. Al with 0.02 to 0.1 μm in thickness is deposited on the entire surface thereof. The Al deposited film is processed by chemical etching and separated in the same electrode shape as that shown in FIG. 9A to provide the target electrode 102 and the guard electrode 315. The insulating thin film, the hole injection blocking layer, the semiconductive layer and the surface layer are sequentially formed thereon, thereby providing the image pick-up tube target for x-ray.

EXAMPLE 8

$Sb_2S_3$ is deposited in Ar gas with 0.4 Torr in pressure on the surface layer of the image pick-up tube target except for the effective scanned region to additionally form the porous surface layer with 0.2 μm in thickness, thereby providing the image pick-up tube target.

Figure 11:
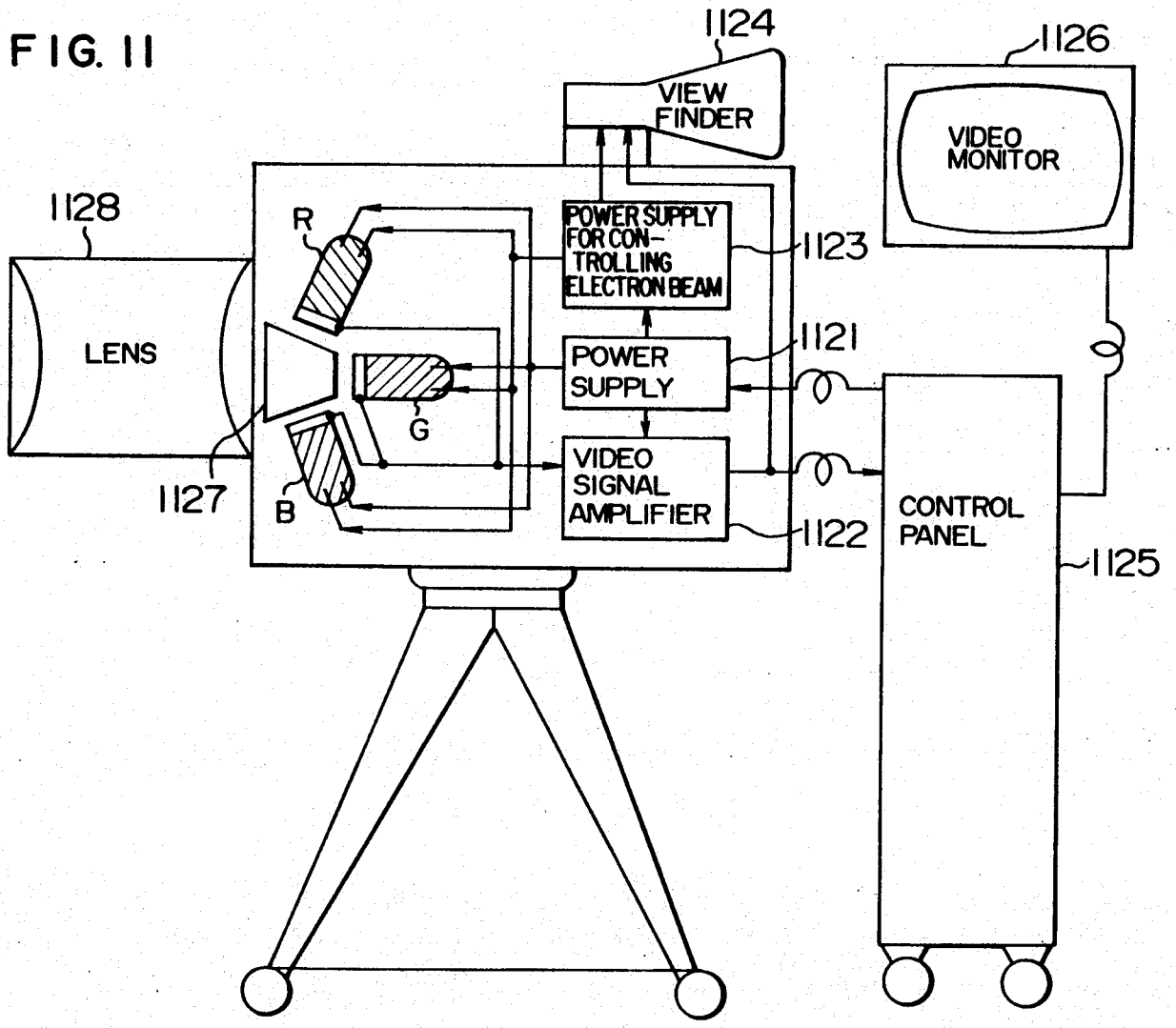
FIG. 11 is a block diagram showing an arrangement of an embodiment when the image pick-up tube according to the present invention is applied to a three-tube system of color camera apparatus for a high definition TV.

FIG. 11 is a rough block diagram showing a main portion of a color camera apparatus of a three-tube system for high resolution television which employs the image pick-up tube according to the present invention. Symbols R, G and B indicate image pick-up tubes for R, G and B channels according to the present invention. Numeral 1121 indicates a power supply, 1122 video signal amplifier, 1123 power supply for controlling an electron beam, 1124 a view finder, 1125 a control panel, 1126 a video monitor, 1127 color resolution prism, and 1128 a lens.

With the color camera, a voltage is applied to the target electrode of each image pick-up tube from the power supply 1121 such that it is positive with respect to the cathode electrode, so that the tube operates at such electric field as avalanche multiplication occurs in the photoconductive film. For example, in case that the image pick-up tube according to the present invention, which has the photoconductive film with 2 μm in thickness composed of amorphous Se as a main component, is used, the target voltage is 240 V, and the number of scanning lines are 1125, images reproduced by the very high sensitive high definition TV system can be obtained about ten times as good as a conventional camera, without defect in a reproduced image such as distortion, shading, water fall phenomenon and signal inversion phenomenon.

Figure 12:
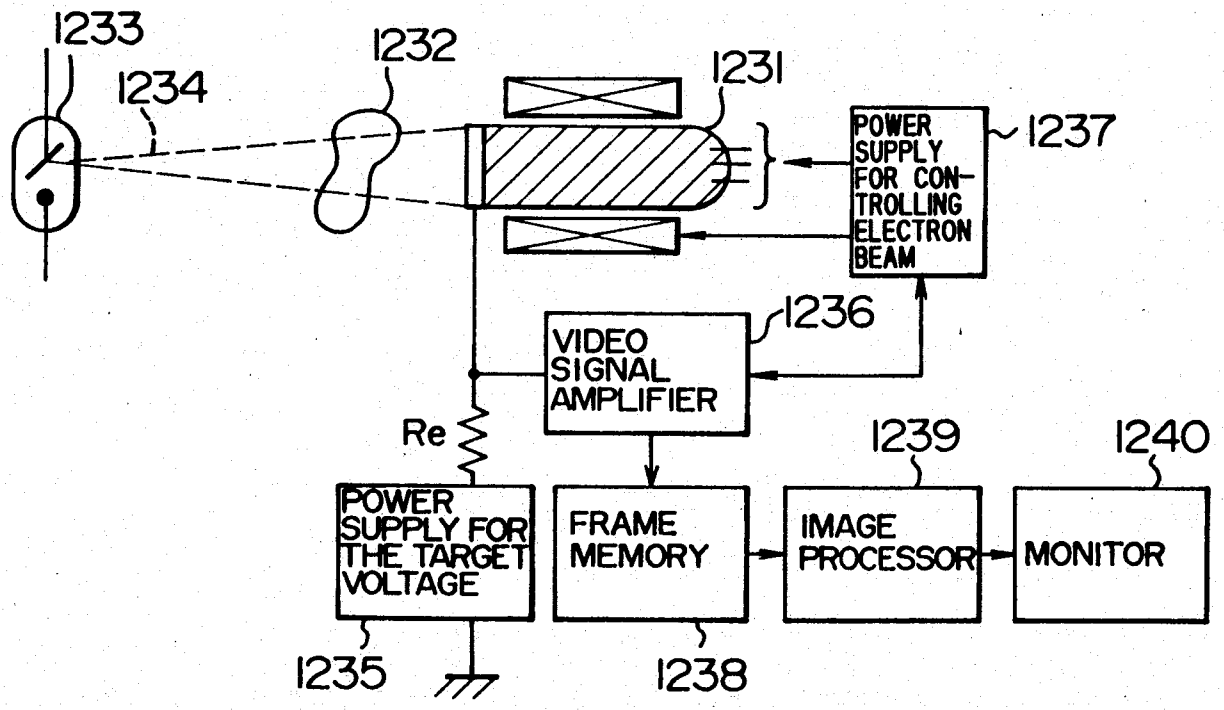
FIG. 12 is a block diagram showing an arrangement of a system when the image pick-up tube according to the present invention is used for x-ray image analysis.

FIG. 12 is a rough block diagram showing an x-ray image analysis system which employs the image pick-up tube according to the present invention. Numeral 1231 indicates the image pick-up tube according to the present invention, 1232 a subject, 1233 an x-ray source, 1234 radiated x-ray, 1235 a power supply for the target voltage, 1236 a video signal amplifier, 1237 a power supply for controlling an electron beam, 1238 a frame memory, 239 an image processor, and 1240 a video monitor. Symbol $R_e$ indicates a load resistor.

For example, in case that the image pick-up tube of the example 7, which has the photoconductive film with 10 μm in thickness containing As of 2 weight percent and composed of amorphous Se, is employed in the x-ray image analysis system shown in FIG. 12, the target voltage is 1,000 V, and the mesh voltage is 2,500 V, the avalanche multiplication can be caused to occur in the photoconductive film, without distortion, shading, water fall phenomenon and a signal inversion phenomenon and hence detection and analysis of x-ray images can be achieved with high sensitivity and high S/N ratio.

When the image pick-up tube which uses the target according to one of the examples 1 to 8 is mounted in a TV camera, even if the target voltage is 300 V, no defect in reproduced images such as shading occurs in a case of using any target. More particularly, when in the image pick-up tube having the guard electrode the guard electrode voltage is lower than 50 V, the defect in the reproduced images is never observed at the more than 500 V target voltage. In the example 5, since the guard electrode is transparent, the effect above mentioned is remarkable. In the image pick-up tube having the guard electrode, an area of the target electrode can be a minimum, with the result that floating electrostatic capacity of the target electrode can be decreased, thereby obtaining a high signal-to-noise (S/N) ratio while the above defect can be suppressed.

As described on the basis of the detailed examples, according to the present invention, the image pick-up tube can be obtained which can operate at increased target and mesh electrode voltages, without accompanying occurrence of image distortion, shading, water fall phenomenon and signal inversion phenomenon and hence characteristics of sensitivity, resolution or after-image of the image pick-up tube can be considerably improved, thereby realizing an image pick-up system of high quality.

The image pick-up tube according to the present invention is suitable for a television camera necessary for high quality, e.g., a camera for high definition TV and if the x-ray image pick-up tube according to the present invention is applied to an x-ray image analysis system, the effect that the system can perform signal processing of high S/N ratio can be obtained.

The invention has been described with reference to the preferred embodiments. Obviously, modifications and alterations will occur to those of ordinary skill in the art upon reading and understanding the present specification. It is intended that the invention be construed as including all such alterations and modifications insofar as they cope with the scope of the appended claims or equivalent thereof.

Having thus described the preferred embodiments, the invention is now claimed to be:

1. An image pick-up tube comprising:

a cathode electrode for emitting an electron beam;

a substrate;

a target section having a surface layer and a photoconductive film for converting an electromagnetic wave into charge carriers as electric signals, the surface layer having a first area to be scanned by the electron beam and a second area not to be scanned by the electron beam, wherein the target section also includes means for balancing a voltage of the second area with a voltage of the cathode electrode;

a target electrode located adjacent and between the substrate and the photoconductive film;

means for scanning the first area by the electron beam so as to read the electrode signals;

wherein the balancing means includes an insulating thin film located proximate the second area.

2. A pick-up tube as set forth in claim 1, wherein the target section includes a first portion and a second portion corresponding to the first and second areas, respectively, and said insulating thin film is located in the second portion.

3. A pick-up tube as set forth in claim 1, wherein said insulating thin film is located between the photoconductive film and the surface layer.

4. A pick-up tube as set forth in claim 1, wherein said insulating thin film is located within the photoconductive film.

5. A pick-up tube as set forth in claim 1, wherein the photoconductive film is located only in the first area.

6. A pick-up tube as set forth in claim 1, wherein the insulating thin film includes a material having a resistivity substantially more than $10^{12}$ Ω-cm.

7. A pick-up tube as set forth in claim 6, wherein the insulating thin film contains at least one component selected from a group consisting of (a) an oxide of Mg, Al, Si, Ti, Mn, Zn, Ge, Y, Nb, Sb, Ta or Bi, (b) a fluoride of Li, Na, Mg, Al, K, Ca, Ge, Sr, Ln or Ba, (c) a nitride of B, Al or Si, (d) silicon carbide, (e) zinc sulfide and (f) a polyimide insulator.

8. A pick-up tube as set forth in claim 1, wherein at least a portion of the substrate includes in insulative glass and the target electrode includes a conductive film which is extended on the insulative glass.

9. A pick-up tube as set forth in claim 8, wherein the conductive film is extended on the substrate and includes a first film portion corresponding to the effective scanned region and a second film portion corresponding to the region not scanned, the first film portion being insulated from the second portion.

10. A pick-up tube as set forth in claim 9, wherein the first film portion corresponding to the effective scanned region includes a transparent conductive film.

11. A pick-up tube as set forth in claim 9, wherein the first and second film portions are separated and insulated from each other and are connected to a plurality of electrode pins which pass through the substrate.

12. A pick-up tube as set forth in claim 1, wherein the substrate includes a material which allows incoming x-rays to permeate.

13. A pick-up tube as set forth in claim 12, wherein at least a portion of the substrate includes a thin plate selected from the group consisting of Be and Ti.

14. A pick-up tube as set forth in claim 1, wherein a secondary electron emission yield of at least the second area of the surface layer on a side corresponding to a portion of a region not scanned is smaller than a secondary electron emission yield of the first area of the surface layer corresponding to the effective scanned region.

15. A pick-up tube as set forth in claim 1, wherein at least the second area of the surface layer on a side corresponding to a portion of a region not scanned includes a porous layer.

16. A pick-up tube as set forth in claim 15, wherein at least a portion of the porous layer contains at least one component selected from a group consisting of (a) an oxide of Mg, Al, Si, Ti, Mn, Zn, Ge, Y, Nb, Sb, Ta or Bi, a fluoride of Li, Na, Mg, Al, K, Ca, Ge, Sr, Ln and Ba, (c) a nitride of B, Al or Si, (d) silicon carbide, (e) zinc sulfide and (f) a polyimide insulator or contains at least one component selected from a group consisting of compounds each of which compounds contains at least one of Zn, Cd, Ga, In, Si, Ge, Sn, As, Sb, Pb and Bi and at least one of S, Se and Te.

17. A pick-up tube as set forth in claim 1, wherein the photoconductive film includes a blocking type contact for preventing charge injection from the target electrode into the photoconductive film.

18. A pick-up tube as set forth in claim 17, further comprising a blocking layer for preventing a plurality of holes injected from the target electrode into the photoconductive film, wherein said blocking layer includes an n-type semiconductor.

19. A pick-up tube as set forth in claim 17, wherein the photoconductive film is capable of charge multiplication.

20. A pick-up tube as set forth in claim 19, wherein the insulating thin film is located on a surface of the photoconductive film.

21. A pick-up tube as set forth in claim 19, wherein at least a portion of the photoconductive film includes an amorphous semiconductor having Se.

22. A pick-up tube as set forth in claim 19, wherein the photoconductive film includes an amorphous semiconductor.

23. A pick-up tube as set forth in claim 22, wherein the amorphous semiconductor comprises Se.

24. A pick-up tube as set forth in claim 1, wherein said insulating film is located between the target electrode and the photoconductive film.

25. An image pick-up tube apparatus for converting photo-signals into electrode signals, comprising:

a cathode electrode for emitting an electron beam;

a substrate;

a target section having a surface layer and a photoconductive film for converting an electromagnetic wave into charge carriers as electric signals, the surface layer having a first area to be scanned by the electron beam and a second area not to be scanned by the electron beam, wherein the target section includes means for balancing a voltage of the second area with a voltage of the cathode electrode, a target electrode located adjacent and between the substrate and the photoconductive film, and means for scanning the first area by the electron beam so as to read the electrode signals, wherein the balancing means includes an insulating thin film located proximate the second area; and means for applying a voltage to the target electrode.

26. An apparatus as set forth in claim 25, wherein the photoconductive film is capable of charge multiplication and includes a blocking type contact for preventing charge injection from the target electrode into the photoconductive film under an applied filed which induces the charge multiplication in the photoconductive film.

27. An apparatus as set forth in claim 26, wherein said insulating thin film is located between the photoconductive film and the surface layer.

28. An apparatus as set forth in claim 25, wherein the photoconductive film includes an amorphous semiconductor for multiplying the carriers.

29. An apparatus as set forth in claim 28, wherein the voltage applying means is arranged to apply an electric field to the target electrode, so as to induce charge multiplication of the carriers in the amorphous semiconductor.

30. An apparatus as set forth in claim 28, wherein the amorphous semiconductor comprises Se.

* * * * *